United States Patent [19]

Beyer et al.

[11] Patent Number: 4,850,173

[45] Date of Patent: Jul. 25, 1989

[54] PROCESS FOR THE INHIBITION OF SPREAD OF FIRE AND FOR PROTECTION AGAINST EFFECT OF FIRE IN BURNING BUILDINGS

[75] Inventors: Herman Beyer; Gabriella Borbély; Sándor Dombi; Alajos Kálmán; Gyula Mészáros; Péter Miasnikov; Pál Rózsa, all of Budapest, Hungary

[73] Assignee: Magyar Tudományos Akadémia Központi Kémiai Kutató Intézete and Építéstudományi Intézet, Budapest, Hungary

[21] Appl. No.: 120,635

[22] Filed: Nov. 13, 1987

[30] Foreign Application Priority Data

Nov. 14, 1986 [HU] Hungary ..... 4692/86

[51] Int. Cl.[4] ..... E04C 2/00

[52] U.S. Cl. ..... 52/741; 52/232

[58] Field of Search ..... 52/232, 741

[56] References Cited

U.S. PATENT DOCUMENTS

| | | | |
|---|---|---|---|
| 3,948,830 | 4/1976 | Donnelly et al. | 524/227 X |
| 4,058,947 | 11/1977 | Earle et al. | 52/396 |
| 4,405,682 | 9/1983 | Fujita et al. | 428/317.7 |
| 4,529,467 | 7/1985 | Ward et al. | 52/232 X |
| 4,660,338 | 4/1987 | Wagner | 52/232 |
| 4,729,853 | 3/1988 | von Bonin | 428/920 X |

*Primary Examiner*—Carl D. Friedman

*Attorney, Agent, or Firm*—Schweitzer & Cornman

[57] ABSTRACT

The invention relates to a process for inhibiting spread of fire in buildings on fire and for protection against the effect of fire wherein heat insulating layer is applied onto the surface of movable and fixed building structures, involving the use of heat insulating materials in the joints of movable and fixed building structures wherein as heat insulating material heat-absorbent hydrophylic silica and/or aluminosilicate based adsorbent, preferably synthetic A-, X- or P-zeolite is used.

4 Claims, 1 Drawing Sheet

PROCESS FOR THE INHIBITION OF SPREAD OF FIRE AND FOR PROTECTION AGAINST EFFECT OF FIRE IN BURNING BUILDINGS

FIELD OF THE INVENTION

The present invention relates to a process for the inhibition of spread of fire and for protection against its effects in burning buildings. By the aid of the present process the spread of the fire and any normally resulting rapid deterioration of building stability can be slowed down and collapse of a structure can be delayed.

BACKGROUND OF THE INVENTION

In burning buildings the rapid spread of fire, the burning through of doors, and the fast decrease of the structural load bearing capacity of steel pillars, beams, metal structures and the like cause the most frequent and the heaviest damage from the fire.

One of the main requirements of fire-retardant materials is the best possible heat insulating ability. The objective of such materials is to inhibit the flow of heat towards the part of the building or the building structure to be protected as effectively as possible. The role of fire inhibiting materials is a ual one with regard to its function.

By their heat insulating capacity fire inhibiting materials installed as layers into fire inhibiting structures such as closures, movable and fixed walls, false roofs, or ceilings, etc., slow down the flow of heat through the fire inhibiting construction, thus also the spread of fire within the building.

Covering the surface of building structures and apparatus which would loose their functionality upon being heated to unduly high temperatures; they slow down the extreme heating of such structures due to their heat insulating capacity. This protection is of great significance in case of structures that support the building e.g. piers, beams, and struts, since they loose their statical stability and load capacity at certain elevated temperatures.

In recent years various methods became known for decreasing structural damage caused by fire. For example, Hungarian Pat. No. 165,720 discloses the use of dicalcium-silicate, sodium silicate, a mixture containing sodium silicate, blowing agent, gas concrete, sludge containing chrome alum earth, and alum earth sludge containing alumina against the spread of fire.

Gas concrete can be advantageously used as a lining structure material in metallurgy because of its heat resistance, but it has not gained wide acceptance in the construction indus try, because it has poor heat insulating qualities. In the case of fire, gas concrete protects the steel structure of buildings against heat only for a short time of several minutes. Then its stability rapidly degrades due to the effect of the heat.

The protective plastering disclosed in Hungarian Pat. No. 163, 497 has a similar disadvantage. It relates to plastering containing mineral additives such as sand, ground rock and/or other minerals, and an organic adhesive, such as latex dispersion, plastic, asphalt or a resin in an aqueous or organic solvent.

Materials with good heat insulating characteristics, such as firebrick, asbestos, rock wool, glass wool, pearlite, guhr, etc., which can be impregnated with waterglass are used for inhibition of the spread of fire. Also foaming paint coatings can be applied onto the surface of the structures to be protected, also containing various inorganic extenders, such as 10 to 15% of clay mineral.

The protecting effect of fire inhibiting materials remains effective only for a short time. From the point of view of effectiveness of fire fighting and minimalizing loss of human life and materials, the time interval of the protective effect is of essential importance.

Since the thickness of insulating layers is limited by constructional considerations, the use of every material is considered as a technical advance the use of an equal thickness of which provides a greater protecting effect against fire than any other material.

Conventional fire inhibiting materials can only be applied to enclose structures to be protected to prevent extreme heating of certain building structures above the critical temperature. The use of such material can be advantageous when filled into existing or created hollow parts within structures to be protected. They also exert protection against fire by another mode of action.

Such fire inhibiting materials can ensure more effective protection against damage which could not be sufficiently realized by conventional insulating materials because of constructional limitations. Generally the protecting effect of structures against the effects of fire was limited, because they have relatively quickly deteriorated in their ability to function according to their purpose.

In a search for materials with heat absorbent characteristics to keep down the heating of supporting elements, experiments were carried out with various salt hydrates that bind water in their crystal structure. Such salt hydrates include Glauber salt and calcium chloride. These materials have a number of drawbacks which render their practical use impossible. These drawbacks include:

When exposed to fire, at a higher temperature anhydrous salts may chemically attack the material of the structures to be protected.

toxic gases can be formed because of their thermal decomposition they can cause or accelerate the corrosion of fire inhibiting and protecting structures due to their hygroscopic character their fire protecting effect decreases with time because of their decrepitation (dehydration), their volume and morphological habit will alter during the dehydration, their heat insulating capacity is rather low.

Experiments were carried out with hydrophylic silica and with aluminosilicate adsorbents, primarily with zeolites of the A, P and X type. In the experiments asbestos as an insulating material was placed in the outer space of a tubular still made of quartz. A test pot containing the fire protecting materials to be tested was placed in the inner space of the still. The tubular still was heated to 620° C. and the temperature in the middle of the test pot and at the edge thereof was measured as a function of time. The temperature measured at the edge exhibited uniform rise in every experiment, while the tendency of the temperature in the middle of the inner space depended on heat insulating capacity and heat absorption capacity of the material that was examined. The character of the temperature curves of dehydrated zeolites was found to be identical. No measurable difference was found between kaolinite and metakaolinite. On the contrary while testing zeolites the temperature reached a given value only after a comparatively longer time. The delay of temperature rise took place in a temperature range of 1°–350° C.

The measurement was repeated with a test pot being empty on the inside placed in the tubular still and heated to 620° C. The outer space was filled with the material to be examined (asbestos, dehydrated and hydrophylic A-zeolite). The zeolite sample being tested had a particle size of 0.5 to 1.5 mm, and it did not contain any binding material. The temperature curves showed that the heat insulating capacity of dehydrated A-zeolite is slightly superior to that of asbestos, while hydrophylic A-zeolite exhibited essentially higher delay of temperature rise due to its heat insulating capacity and concommitant heat absorbent capacity.

DESCRIPTION OF THE INVENTION

On the basis of experiments and measurements we recognized that fire protection effectiveness of a given adsorbent is defined decisively by its water absorption capacity and water desorption heat requirement thereof. As a consequence, though theoretically every incombustible hydrophylic adsorbent is more or less suitable for this purpose, only a few synthetic zeolites exhibiting the highest water adsorption capacity ensure the best fire inhibiting protective effect, such as X-zeolite with faujazite structure, A-zeolite and P-zeolite. The water content of these zeolites amounts to about 24%, 22% and 20%, respectively, related to their air-dry state. Considering the volume weight of about 1 kg $dm^{-3}$ of suitably formed zeolites and the average desorption heat of zeolite water, which is about one and a half times its condensation heat, the dehydration of the three above listed synthetic zeolites consumes 812, 744, and 677 kg $dm^{-3}$ respectively. This represents an amount of energy required to evaporate a quantity of water as high as 36, 33 and 30% of the volume respectively.

Steam is generated during dehydration. This can be used to prevent the propagation of smoke and flue gases. The volume of the steam at 100° C. is 420-, 380-, and 3340-fold the volume of the X-, A- and P-zeolite, respectively.

Based on this recognition the spread of fire in burning buildings can be inhibited and the effect of fire can be decreased by applying heat insulating material to the surface of movable and fixed structural elements of the building, inserting heat insulating materials in the area of joints between movable and fixed building structures, and using heat absorbent, hydrophilic, silica and/or alumino silicate based adsorbent, suitably synthetic A-, X- or P-zeolite, as heat insulating material.

The effectiveness of the heat draining adsorbent can be increased so, that at least one cavity is formed in or from the movable and/or fixed building structure and said cavity or cavities is or are filled with an adsorbent which shows a heat absorbent character.

The propagation of smoke generated by fire can be advantageously minimized by providing openings on the wall of the cavity, and the steam escaping the adsorbent is led to the gap(s) between building structures through the openings.

Structures especially those made of wood, such as roof joists and beams can be protected with the highest efficiency so that the adsorbent is applied to the structure by spraying an epoxy binding material with the adsorbent admixed thereto.

Protection of large surfaces that are larger than doors, such as walls, can be achieved most advantageously by bonding panels from materials having heat absorbent properties with conventional adhesive onto the surfaces to be protected.

DESCRIPTION OF THE DRAWING

The process according to the present invention is disclosed in detail with reference to the Examples and to the drawing, wherein.

EXAMPLE 1

Figure 2:
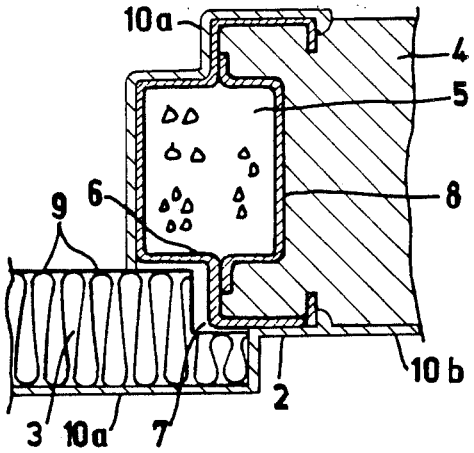
FIG. 2 is a cross sectional view taken at "A" of FIG. 1.
Figure 1:
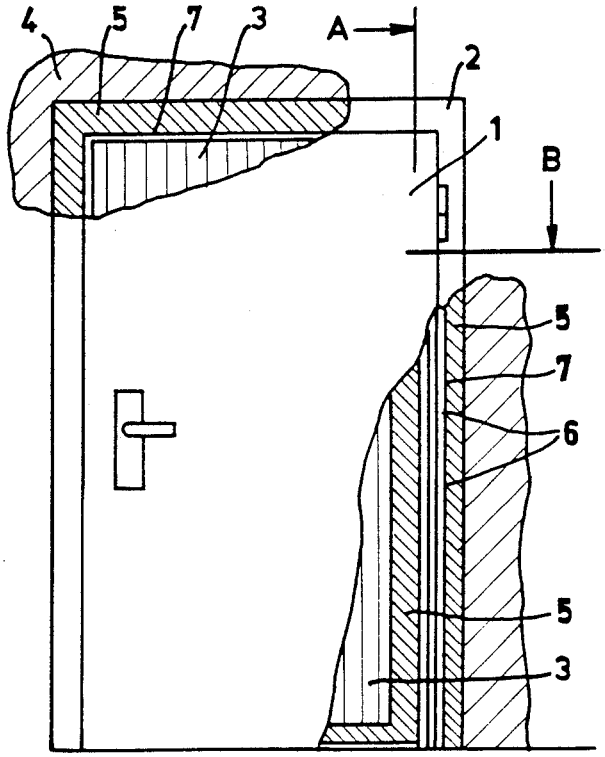
FIG. 1 is a partially broken away elevational view of a protected door.

Burning through a door as an example of a movable building structure was tested. The spread of fire was inhibited according to FIG. 1 and FIG. 2 in which a door frame 2 holding a door panel 1 was built in a wall 4. The frame 2 was a steel element with a U-shaped profile bent from a steel sheel 11. This U-shaped profile was closed on its side facing the wall 4 by a closing sheet 8, and the cavity formed thereby was filled with granulated X-zeolite. A mixture of epoxide binding material and zeolite powder was applied to the outer surface of panel 1 of the door by spraying and thus a heat absorbent layer 10 was formed thereon. The space between steel sheet covers 9 of the panel 1 of the door was filled with an insulating material 3, in the present case with a corrugated isolite sheet. An insulating layer was applied by spraying to the door frame 2 as well as to the outer side of the wall 4. Heat insulating panels 10b were affixed by bonding to the inner side of wall 4. The panels were molded from a mortar containing particles of heat absorbent A-zeolite and a cement.

Vent holes 6 are formed in the door-frame 2 filled with zeolite along a gap 7 between the door-frame and the panel 1 of the door.

EXAMPLE 2

Figure 3:
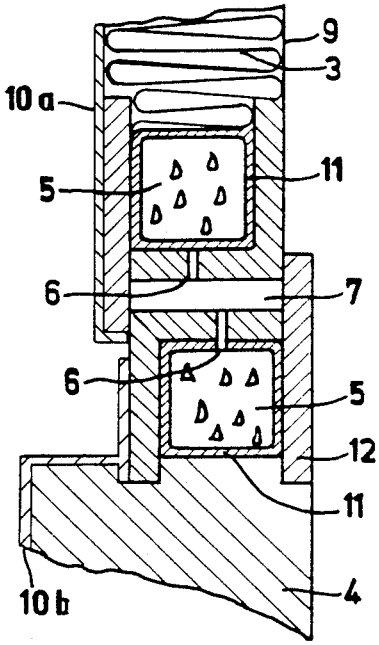
FIG. 3 is a cross sectional view taken at "B" of FIG. 1.

The right side of the test door structure described in Example 1 was built as shown in FIG. 3. A cavity was formed from steel sheets 11 inside the door-frame 2 and the space between the steel sheet covers 6 of the door. The cavities were provided with holes representing vents 6 directed into the interspace 7 between the door-frame and panel 1 of the door. The cavities were filled with scrap of hydrophlyic P-zeolite. The position of steel sheets 11 of the cavities was fixed with refractory shim supports 12.

If exposed to fire the doors built as described above have a heat insulating property only up to 100° C. If the temperature rises to about 300° C. the water in the crystal structure of zeolite filled into the cavities will escape as steam whereby the major part of the heat is absorbed by the zeolite.

The same effect is produced by heat absorbent zeolite layers 10a applied to the panel 1 of the door and to the door-frame 2, as well as by zeolite slabs 10b bonded onto the wall 4. The spread of fire will be impeded due to the heat absorption capacity of zeolite and the same degree of damage to the building structures will occur in about twice the amount of time than in the general case without such protection with zeolite. This can considerably minimize losses caused by fire.

EXAMPLE 3

A 2m long reinforced concrete supporting beam of 60 cm diameter was formed with a hollow channel of 20 cm diameter and the cavity was filled with P-zeolite.

P-zeolite can be prepared in a simple manner, starting from low cost materials or from waste material though a large scale industrial synthesis process. The crystalline structure of P-zeolite collapses during the dehydration required for its application as an adsorbent. In using P-zeolite as fire inhibiting material the thermal instability of its structure is particularly advantageous since the collapse of its crystal lattice represents an endothermal or heat absorbing process. Another advantage resides in that the scrap as waste material obtained in manufacturing shaped A- and X-zeolite items can be directly used as fire inhibiting material, because using zeolites for this purpose does not require a forming to uniform weight and shape. An effect was observed when heating the beam under test to 300° C. The temperature measured inside the beam reached the 300° C. level considerably later than in the case of a similar solid reinforced concrete beam.

EXAMPLE 4

Roof elements, such as wooden beams and roof battens were partly coated by a spraying layer of A-zeolite base material and epoxide bonding material. On drying the layer the roof structure was set on fire and it was observed that after about 5 minutes non-treated beams and battens burst into flame and battens collapsed under the effect of their own weight in 8 minutes, while the structure made from beams and battens coated with the zeolite layer collapsed only after 17 minutes.

As its becomes clear from the examples the use of hydrophylic silica or aluminosilicate based adsorbents, primarily zeolites in accordance with the invention as fire inhibiting materials, entirely differs from conventional methods as far as their action and structure are considered. The fire inhibiting materials in accordance with the present invention ensure proper protection during a fire for a significantly longer time as compared to conventional fire inhibiting materials. The fire inhibiting material in accordance with the present invention exert their protective effect also when disposed within structure. Therefore, in contrast to conventional inhibiting materials, the materials can be used in accordance with the invention also in cases when for constructional reasons the outer surface of a structure to be protected cannot be sufficiently coated with heat insulated material.

Good heat insulating character of silica or alumino, silicate based adsorbents used according to the invention also provide the effect available from conventional fire inhibitors. A heat absorption process also takes place in the temperature range generally from 80° C. to 350° C., depending on the nature and the water steam pressure of the surrounding atmosphere. The water adsorbed inside the pore structure of adsorbents or zeolite crystals is then desorbed as steam. Because of the endothermal character of this process the major part of the heat energy entering the fire inhibiting adsorbent layer will not increase the temperature of the material during the desorption process. This is apparently identical to the temporary strong rise of the heat insulating cavity of the material. In the course of fire the temperature of supporting structures to be protected and the fire inhibiting structures especially on the side not directly exposed to the effect of fire, will rise in the temperature range up to 350° C. significantly more slowly due to this phenomenon. In accordance with the invention hydrophylic adsorbents, suitably zeolites, are also used inside of building structures. For theoretical reasons this is inapplicable to fire inhibiting materials having only a thermal insulating character.

The crystal lattice of some zeolites with cubic crystal structure will collapse during exposure to heat at up to 350° C. This temperature range is important for fire protection and the process involves heat absorption. This irreversible process of heat absorption intensifies the feature of zeolites which are advantageously employed for fire protection.

A considerable amount of steam is generated in the he course of fire induced dehydration of the adsorbent in fire inhibiting building structures. This is led into the gaps within the structures and acts against gases and smoke developed by fire. Thus gases and smoke cannot stream into the parts of the building which are not yet on fire. The fire inhibiting material in accordance with the present invention provides protection in case of fire not only against the effect of heat but also against gaseous products of combustion and retards the spread thereof.

Building in of adsorbents containing large amounts of adsorbed water can be technically relatively easily accomplished and adapted in various ways most suitable to the given application. The water bound in silica and alumino silicate based adsorbents and also the carrier matrix itself does not result in any corrosion problems. At ambient temperatures below 60° C. the shelf life of materials containing adsorbed water is unlimited and no decrease of fire protective effectivity occurs. In the case of fire, at higher temperatures, neither chemically aggressive materials that can attack the material of a structure, nor toxic gaseous products, are generated.

We claim:

1. A process for inhibiting the spread of fire in buildings on fire, and for protection against the undesirable effects of fire, comprising installing one or more of a synthetic A-, X-, or P-zeolite as a heat insulating heat absorbent into fixed building structures and into the joints of movable building structures.

2. The process of claim 1, wherein a hollow space in a movable and/or fixed building structure is filled with said heat insulating heat absorbent material.

3. The process of claim 1, further comprising mixing said heat insulating, heat absorbent material with an epoxy binder, and the applying of said heat insulating, heat absorbent material comprises spraying it onto the surfaces of said structures.

4. The process of claim 1, which comprises molding panels from said heat insulating, heat absorbent material and attaching said panels to the surface of said movable and fixed building structures.

* * * * *